US007491013B2

(12) United States Patent
Bohse

(10) Patent No.: US 7,491,013 B2
(45) Date of Patent: Feb. 17, 2009

(54) CONCRETE SCREED

(76) Inventor: Marc A. Bohse, 1131 Rush Rd., New Madison, OH (US) 45346

( * ) Notice: Subject to any disclaimer, the term of this patent is extended or adjusted under 35 U.S.C. 154(b) by 0 days.

(21) Appl. No.: 11/735,805

(22) Filed: Apr. 16, 2007

(65) Prior Publication Data

US 2008/0253836 A1 Oct. 16, 2008

(51) Int. Cl.
*E01C 19/22* (2006.01)

(52) U.S. Cl. ..... 404/118

(58) Field of Classification Search ..... 404/118; 15/235.4

See application file for complete search history.

(56) References Cited

U.S. PATENT DOCUMENTS 237,891 A * 2/1881 Musselman ..... 16/426
3,082,460 A * 3/1963 Haivala ..... 15/235.4
4,256,416 A * 3/1981 Bishop ..... 404/119
4,591,291 A 5/1986 Owens
4,848,961 A 7/1989 Rouillard
5,605,415 A * 2/1997 Shamblin ..... 404/118
5,980,154 A * 11/1999 Record ..... 404/97
6,296,467 B1 * 10/2001 Rouillard ..... 425/182
6,523,619 B1 * 2/2003 Cherry ..... 172/684.5
6,704,968 B2 * 3/2004 Lau ..... 16/426
6,728,994 B1 * 5/2004 Rushin et al. ..... 16/426
7,010,828 B1 * 3/2006 Flores et al. ..... 15/235.3

* cited by examiner

*Primary Examiner*—Gary S Hartmann
(74) *Attorney, Agent, or Firm*—R. William Graham

(57) ABSTRACT

A hand screed for screeding fluid material includes an elongated beam having a bottom surface for disposal adjacent a surface to be screeded and an elongated handle removably connected to the beam.

5 Claims, 3 Drawing Sheets

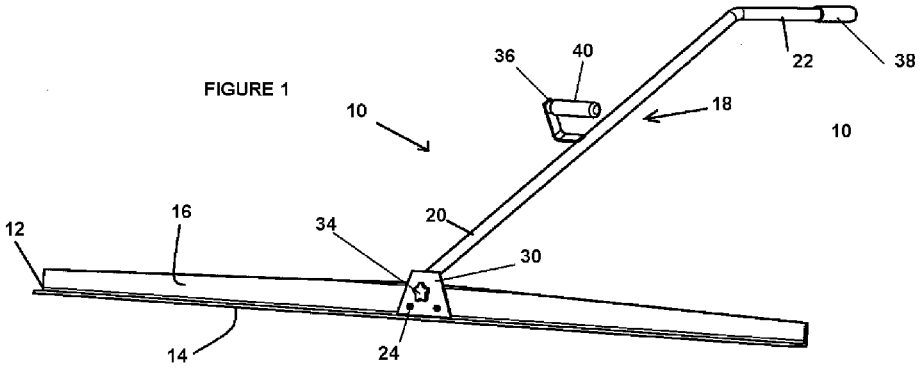
FIGURE 1
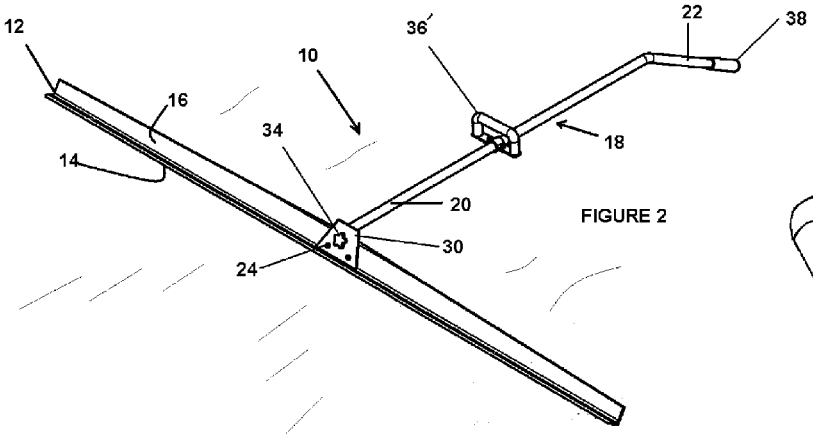
FIGURE 2
FIGURE 7
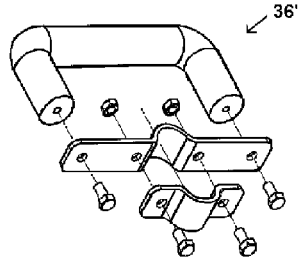

FIGURE 3
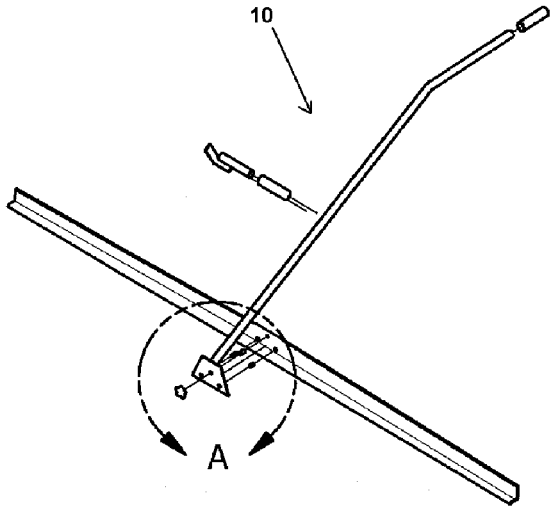
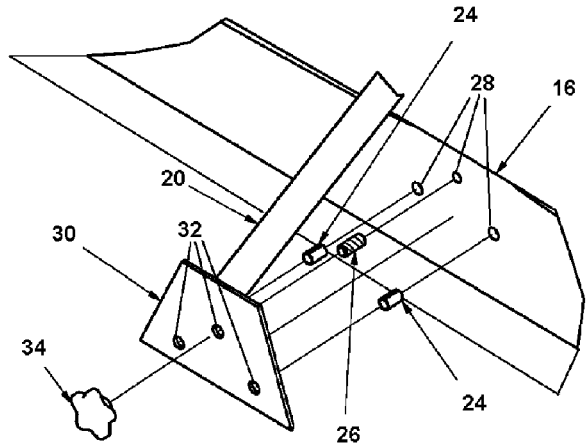
FIGURE 4

FIGURE 5
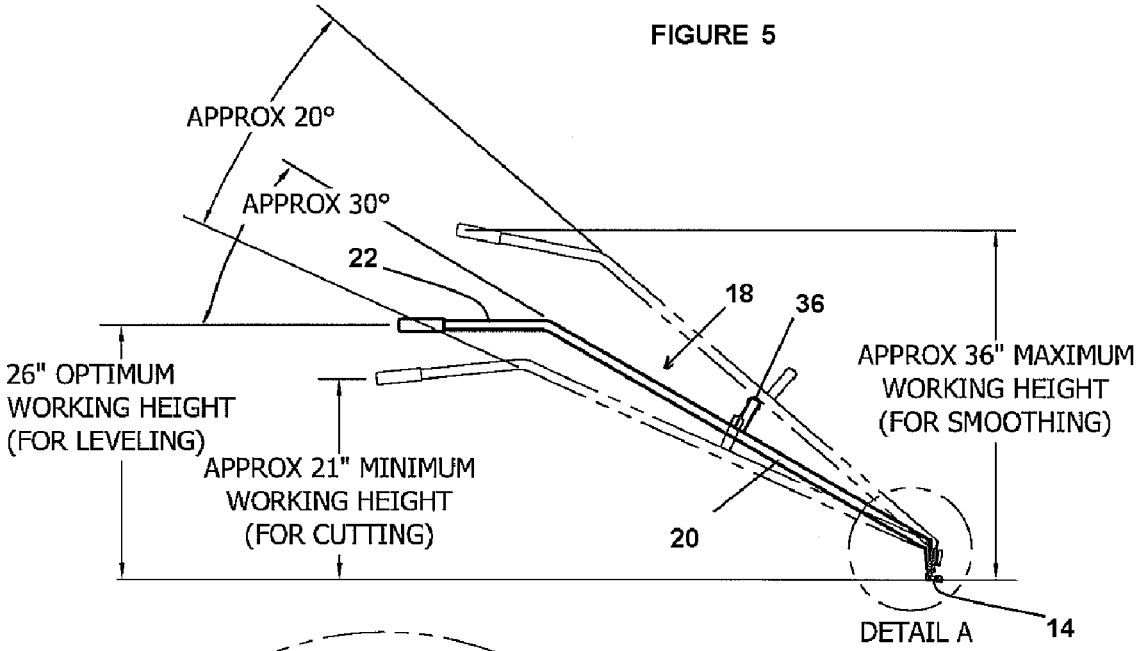
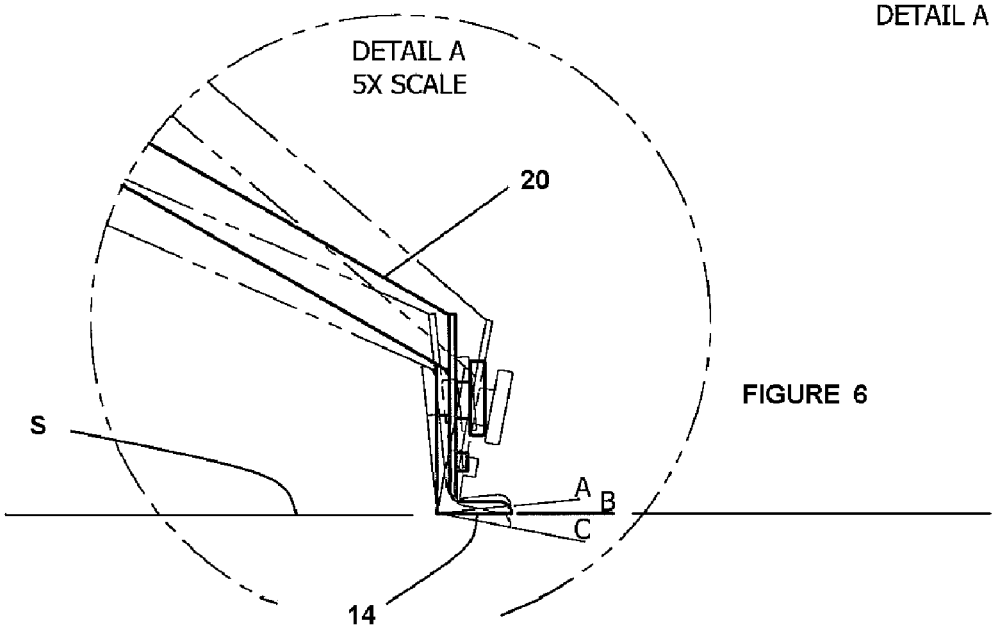
FIGURE 6

CONCRETE SCREED

BACKGROUND OF THE INVENTION

1. Field of the Invention

The present invention relates to a concrete screed, and particularly to an improved handheld portable and lightweight concrete screed enabling a workman to use same with minimal back strain.

2. Description of Prior Art

There are various types of screeds for leveling concrete. Such screeds include both handheld and vibrating type screeds which are used in conjunction with rigid forms. Such forms are placed and adjusted to provide the appropriate slope to the slab which is being produced. For large jobs, power screeds are employed. However, most mid size jobs still employ hand operated screed.

Common to most screed devices is a beam used for striking off the surface of concrete or other material during the making of a roadway or similar structures (screeding). In the case of powered screeds, the beam is supported by rigid side forms and provided with vibrating means and often require multiple operators. A problem of this screed is that it is cumbersome in set up and structure and requires several operators. Another problem with power operated screeds is that the slab which results is not completely flat as the edges of the screed plate have the tendency to penetrate into the fresh concrete or to rise above the surface.

Typical hand screeds include a rail or beam, commonly a long 2×4 board, which is typically manipulated by hand to achieve a smoothing of the concrete surface. In most instances, professional concrete workers still prefer a hand screed finish, but dislike the back pain associated with the hand screed.

The present invention described herein aims at overcoming problems in the art in providing a novel hand screed device.

OBJECTS OF THE PRESENT INVENTION

An object of the present invention is to improve screed devices.

Another object is ease handling poured material.

Still another object is to provide an improved handheld screed for smoothing off of freshly poured concrete.

Another object is to provide a screed which is lightweight and portable.

Yet another object is to provide a screed which is inexpensive to manufacture.

Still another object is to provide a screed capable of screeding large concrete slabs, such as driveways, by a single workman.

Another object is to provide a quick-connect-disconnect multi-part hand screed to enable ease of transport and usability.

Accordingly, the present invention is directed to an improved hand screed for screeding fluid material. The hand screed includes an elongated beam having a generally planar bottom surface for disposal adjacent a surface to be screeded and an upwardly extending surface, and an elongated handle having a first end removably connected to the beam, preferably to the upwardly extending surface and the handle having a second end. The elongated handle is connected generally perpendicular to the beam.

The elongated beam can be formed in a generally L shaped cross section wherein the upwardly extending surface includes a plurality of retaining members extending outward therefrom, wherein at least one of the members can preferably include a threaded surface. The elongated handle can preferably include a flange extending from the first end which has a plurality openings spatially positioned to receive the retaining members therethrough and wherein a threaded member can be provided to threadably secure to the threaded retaining member thereby retaining the handle to the beam. When the handle is connected to the beam, the handle can preferably assume between about 20° to 40°, preferably 30°, angle with respect to the bottom surface of the beam. Additionally, the second end of the handle can preferably include a terminal portion which is bent at between about 20° to 40° relative to the first end. Additionally, the first end also includes a second short handle extending transverse to the elongated handle.

DESCRIPTION OF THE DRAWINGS

These and other objects of the invention will be more fully and better understood by reference to the accompanying drawings in which:

FIG. 1 is a perspective view of a screed embodying the present invention;

FIG. 2 is another perspective view of a screed according to the present invention.

FIG. 3 is an exploded perspective view of a screed according to the present invention.

FIG. 4 is an enlarged detail of a portion of FIG. 3.

FIG. 5 is a side view of a screed according to the present invention showing working angles.

FIG. 6 is an enlarged detail of a portion of FIG. 5.

FIG. 7 is a view of an alternative handle for use in the invention.

DETAILED DESCRIPTION OF A PREFERRED EMBODIMENT

Referring now to the drawings, the concrete screed of the present invention is generally designated by the numeral 10 and is for screeding fluid material. The hand screed 10 includes an elongated beam 12 having a generally planar bottom surface 14 for disposal adjacent a working surface S to be screeded and an upwardly extending surface 16.

An elongated handle 18 has a first end 20 removably connected to the beam 12, preferably to the upwardly extending surface 16 and the handle 18 has a second end 22. The elongated handle 18 can be connected generally perpendicular to the beam 12.

The beam 12 is elongated and can be formed in a generally L shaped cross section, wherein the upwardly extending surface 16 includes a plurality of retaining members 24 and 26 which are fixably disposed in openings 28 of the upwardly extending surface 16 and extending outward therefrom (see FIG. 4). One of the members 26 can preferably include a threaded surface.

The elongated handle 18 can preferably include a flange 30 extending from the first end 22 which has a plurality openings 32 spatially positioned in a complementary manner to receive the retaining members 24 and 26 therethrough. A knob 34 having a threaded nut therein can be provided to threadably secure to the threaded retaining member 26 thereby retaining the flange 30 and in turn the handle 18 to the beam 12.

In viewing FIG. 5, the handle 18 is connected to the beam 12 can preferably assume between about 20° to 40°, preferably 30°, angle with respect to the bottom surface 14 of the beam 12. While the drawings depict the particular connection as a preferred embodiment, it is contemplated that other forms of connectivity may be employed.

The present combination does however provide the benefit of great stability as well as ease of assembly and disassembly. In this regard, the present invention shows retaining members 24 and 26 extending outward from a forward face of the upwardly extending surface 16 to which the flange 30 is mated against and held in place by the members 24, 26 and knob 34. The flange 30 can preferably be rigidly connected or integrally formed with the handle 18. During screeding, the material is typically pulled toward the worker and in this way the flange 30 and handle 18 bear most of the force.

As seen in FIG. 5, the second end 22 of the handle can preferably be bent at about 30° relative to the first end 20. FIG. 6 depicts a working range for the bottom surface 14 relative to the working surface S of the material to be screeded. Angle A represents a minimum working angle height relative to the working surface S, angle B represents an optimum working angle height relative to the working surface S, and angle C represents a maximum working angle height relative to the working surface S. The working range thus is about 20° as seen in FIG. 5, which translates to the second end 22 assuming a position from about 21 inches to 36 inches (about 20° to 40°) from the working surface S. This range is believed to be preferably to reduce back strain as well as aid in ease of use of the device 10.

As seen in FIG. 1, the first end 20 also has connected thereto a second short handle 36 extending transverse to the elongated handle 18 and which is fixably connected thereto. The length of the short handle 36 can preferably be about a hand's width, e.g., 4-5 inches. FIGS. 2 and 7 depict an alternative handle 36' which is includes a clamping connection to permit the same to be movably disposed along the handle 18 to a desired position and then fixed in position. The terminal portion of the second end 22 as well as the handle 36 can be fitted with plastic or rubber sleeves 38 and 40 in order to aid in comfort and use.

The screed 10 is believed to provide an ergonomic design in balance and weight to enable ease of use. In addition to the features already discussed in this regard, the upwardly extending surface 16 can preferably be tapered with a high point toward the middle of the beam 12 (wider middle) and a lower point toward each end of the beam (narrower end) as seen in FIG. 1, for example. The upwardly extending surface 16 can be used to pull and spread the freshly poured concrete, whereas the said bottom surface 14 is used to press down and smooth the concrete to obtain a generally smooth surface. The screed 10 can be made of an alloy, including aluminum, for example, wherein the beam and handle are of a sufficient weight and rigidity to effect a screeding of the material yet light enough to handle.

Screed 10 can preferably be of a length which does not exceed about five feet. The width of the beam can preferably be about seven feet. These dimensions are suitable for most jobs, however, these may vary for other sized jobs, such as sidewalks requiring a smaller beam. Thus, the removability beam 12 from the handle 18 is very helpful in being able to store and transport the screed 10.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A hand screed for screeding fluid material, which comprises:

an elongated beam having being L-shaped in cross-section and having a lower member having a bottom surface for disposal adjacent a surface to be screeded and an upwardly facing surface and an upper member connected to a rear edge of said lower member and generally normal to said lower member and having a forward facing surface and a rearward facing surface; and an elongated handle having a first end removably connected to a middle point of said beam and a second end, wherein said beam and handle are of a sufficient weight and rigidity to effect a screeding of the material, wherein said handle includes a rigid flange extending from said first end in a fixed manner such that said handle is prevented from turning relative to said flange and said flange is disposed adjacent said forward facing surface said forward facing surface having a plurality of retaining members integrally extending therefrom said retaining members oriented approximate midway of said beam and with said flange having a plurality openings spatially positioned in a complementary manner to receive said retaining members therethrough;

means for removably securing to at least one of said retaining members when so received through said opening to fixably secure said flange of said handle to said beam and such that when said beam connects to said first handle said first end extends at between about a 20° angle to 40° angle with respect to said bottom surface of said beam and wherein said second end of said handle extends at between about a 40° angle to 20° angle with respect to said first end; and a second short handle connected to said first handle and extending generally parallel with respect to said beam and transverse to said elongated handle.

2. The hand screed of claim 1, wherein said bottom surface includes a generally planar surface.

3. The hand screed of claim 1, wherein said second handle is movably disposed on said elongated handle.

4. The hand screed of claim 1, wherein said beam is tapered having a wider middle and a narrower end.

5. The hand screed of claim 1, wherein at least one of said retaining members includes a threaded end and said securing means includes a knob having a threaded nut therein to threadably secure to said threaded end of said retaining member thereby retaining said flange and to said beam.

* * * * *